US005108328A

United States Patent [19]

Hull

[11] Patent Number: 5,108,328

[45] Date of Patent: Apr. 28, 1992

[54] TRAINING FIN DEVICE FOR SWIMMING

[76] Inventor: Martin P. Hull, 3516 Farm Hill Blvd. #20, Redwood City, Calif. 94061

[21] Appl. No.: 525,372

[22] Filed: May 17, 1990

Related U.S. Application Data

[63] Continuation-in-part of Ser. No. 292,468, Dec. 30, 1988, Pat. No. 4,948,385.

[51] Int. Cl.[5] ..... A63B 31/10

[52] U.S. Cl. ..... 441/64; 441/61

[58] Field of Search ..... 441/55, 75, 61-65; 36/11.5, 8.1, 113

[56] References Cited

U.S. PATENT DOCUMENTS

| | | | |
|---|---|---|---|
| 1,571,467 | 2/1926 | Waldron | 441/64 |
| 2,099,973 | 11/1937 | DeCorlieu | 441/64 |
| 2,343,468 | 3/1944 | Messinger | 441/64 |
| 3,178,738 | 4/1965 | LaTrell | 441/64 |
| 4,521,220 | 6/1985 | Schoofs | 441/64 |
| 4,689,029 | 8/1987 | Cuccotelle | 441/64 |

*Primary Examiner*—Sherman Basinger
*Assistant Examiner*—Clifford T. Bartz
*Attorney, Agent, or Firm*—Douglas A. Chaikin

[57] ABSTRACT

Disclosed herein is a training fin for swimming which includes a foot section having an enclosure for retaining a user's foot in the fin and a tail section attached to the foot section. The tail section has a surface area of approximately between 0.25 and 1.0 times the surface area of the foot section.

2 Claims, 1 Drawing Sheet

TRAINING FIN DEVICE FOR SWIMMING

CROSS REFERENCE TO PARENT APPLICATION

This application is a Continuation-in-Part of commonly owned patent application Ser. No. 07/292,468, filed Dec. 30, 1988 which has been issued on Aug. 14,1990 as U.S. Pat. No. 4,948,385.

BACKGROUND OF THE INVENTION

Field of the Invention

This invention relates to devices to assist a swimmer and more particularly to swimming devices which assist swimmers to train and condition.

A great deal of strength and conditioning is required to swim at a pace that approaches a competitive race (hereinafter "race pace"). Using traditional training methods, it is virtually impossible to maintain this race pace consistently while training and conditioning the swimmer.

A competitive swimmer must coordinate his legs, arms, body rotation and breathing at an extraordinary level to get the maximum forward progress out of each stroke. This extraordinary coordination can only be learned and practiced at speeds approaching race pace because the plane the swimmer makes with the water is different at different speeds. The faster a swimmer's body goes the higher it planes in the water. At race pace, the swimmer's body approaches a parallel plane with the surface of the water. The entry of his arms in the water on the reach portion of a swim stroke is at a very different angle under casual swimming conditions than at race pace. Thus, the necessary sequence of muscular contractions in the muscles of the shoulders and the upper body (hereinafter neuromuscular coordination) that must be developed while going at a race pace is quite different from the neuromuscular coordination that must be developed during ordinary training.

Typically, at race pace, the swimmer goes all out, his muscles strain to their very limits. However, virtually all of the swimmer's training has been at a more casual training pace. Thus, the neuromuscular coordination developed during training is not the same as that which is needed at race pace. The solution would seem to be obvious, train at race pace. However, as pointed out above, this is impossible because the human body can not withstand constant race pace. The swimmer will approach burn out, possibly become injured and become too fatigued to perform at his best during a race.

The problem, then, would seem to be insurmountable; how can one train such that the necessary muscles, body movement and breathing are extraordinarily coordinated at race pace without over taxing the body. Additionally, the problem is how can the swimmer train for maximum coordination while conditioning the body such that the body is at maximum strength and even peaking during a race.

The instant invention, while seemingly quite simple in design, is in fact an extraordinary solution to a very difficult and complex problem.

Another aspect of competition swimming is remaining conditioned while being injured. A substantial portion of the injuries which occur to swimmers, occur to their shoulders. In the past, a swimmer having only slightly injured shoulder could not hope to train at conditions even approaching race pace. The shoulder would have to heal before the swimmer could hope to regain both his conditioning and coordination.

In effect, the swimmer will give up a substantial portion of his race season because the injury will be devastating to his coordination. While the swimmer can maintain some conditioning by running or lifting weights or using a kick board or doing other exercises that do not involve his shoulders, he can not maintain the coordination of his shoulders, body rotation, kick and breathing unless he can actually swim and use his shoulder.

Many shoulder injuries are slight enough that some light swimming is possible. However, using past training methods, the risk of re-injury was quite great because of the competitive swimmer's strong desire to get back to competition. Using the device of the instant invention, a swimmer is able to train at speeds approaching race pace without placing undue stress on the injured shoulder, such that it becomes re-injured.

Implicit in the instant invention is the recognition that a swimmer puts far less stress on his shoulders during the arm reach when he is planning at a higher level on the water, i.e. when the swimmer is at race pace. The swimmer's arm reaches toward the water at an angle which is far more comfortable, more efficient and less stressful to the shoulders than the arm entry position of the more common training pace. Thus, the instant invention allows the swimmer to continue training at speeds approaching race pace with a minimum risk of re-injuring the injured shoulder.

Swimming is one of the most popular and healthiest forms of recreation available. Many persons learn to swim without proper instruction. As is well known, old habits are difficult to break. Thus, there is an important need to find a device that assists the novice and even the advanced swimmer in developing and continuing the proper swimming technique.

The instant invention employs a swim fin of a particular variety to solve the above problems. While there have been many other swim fins of the type shown in FIG. 1, no known swim fin has been able to accomplish the above. Most swim fins have fin portions which are three to five times the surface area of the foot portion. Such a large fin portion causes too much resistance for the rapid kick motions necessary to swim at race pace. Thus, while such a fin may increase propulsion, it does not allow coordination to swim at race pace.

SUMMARY OF THE INVENTION

It is an object of this invention to provide a training fin which is suitable for assisting a user swim.

It is a further object of this invention to provide a training fin which minimizes shoulder problems by shifting propulsive load from the arms to the legs.

It is a further object of this invention to provide a training fin which assists in achieving race pace coordination of arms and legs. It is a further object of this invention to provide a training fin which benefits cardiovascular and arm and leg conditioning.

It is a further object of this invention to provide a training fin which encourages correct swimming technique.

In accordance with the above objects and those that will be mentioned and will become apparent below, the training fin in accordance with this invention, comprises:

a foot section having an enclosure means for retaining a user's foot to the fin; and a tail section attached to the foot section, the tail section having surface area of approximately between 0.5 and 1.0 times the surface area of the foot section.

The tail section is small enough to allow rapid kick movements which are consistent with race pace. The small tail section also allows the swimmer to maintain his neuromuscular coordination by not causing the high degree of drag of the larger prior art fin.

In a preferred embodiment, the tail section comprises a tapered plane having a base at the juncture of the tail and foot sections. The tapered plane terminates at a finishing edge and the tail section is tapered generally evenly from the base to the finishing edge. The tail section has diverging outside edges extending from the base to the finishing edge and which diverge, generally evenly, from the base to the finishing edge. In a further embodiment, the outside edges have a trim edge adjacent the juncture of each outside edge and the finishing edge. The trim edges are parallel to each other and permit the swimmer to keep his legs closer together during kicking without the fins hitting each other.

In a still further preferred embodiment, the tapered plane joins the foot section at a predetermined angle and wherein the top of the user's foot defines a foot plane upon being inserted into the foot section. The predetermined angle is approximately parallel to the foot plane.

It is an advantage of this invention to enable a user to plane higher in the water, thereby lessening the stress on the shoulder during the reach portion of the stroke.

It is an additional advantage of this invention to enable a user to continue training even during recovery from a shoulder injury.

It is an additional advantage of this invention to enable a user to duplicate race pace conditions without causing the stress and without requiring the stamina of a race.

BRIEF DESCRIPTION OF THE DRAWING

For a further understanding of the objects and advantages of the present invention, reference should be had to the following detailed description, taken in conjunction with the accompanying drawing, in which like parts are given like reference numerals and wherein.

DETAILED DESCRIPTION OF THE INVENTION

Figure 1:
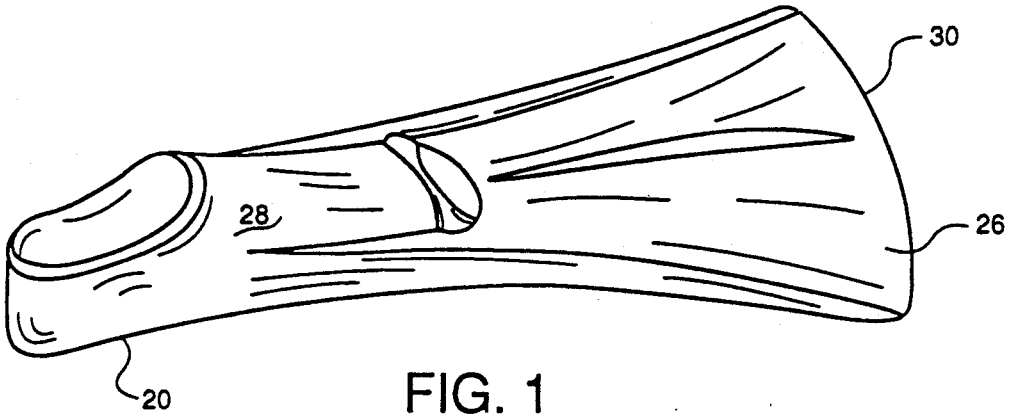
FIG. 1 PRIOR ART
FIG. 1 is a side perspective view of a prior art structure.

The invention will be described below with reference and comparison to the prior art of FIG. 1. FIG. 1 illustrates a prior art fin design. The prior art fin 20 includes a fin portion 26 and a foot portion 28. The portions 26 and 28 are generally integral with no clear line of demarcation. The fin portion 26 terminates at a terminating edge 30.

Figure 2:
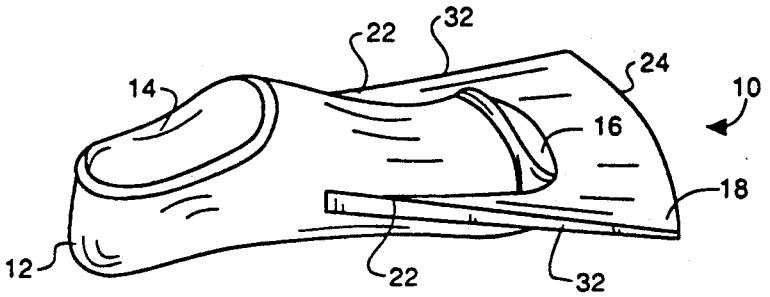
FIG. 2 is a perspective view of the training fin in accordance with this invention.

The first embodiment of the invention will now be described with reference to FIG. 2 which illustrates the training fin in accordance with this invention, generally denoted by the numeral 10. The first embodiment of the training fin 10 includes a foot section 12. The foot section 12 comprises a boot-like structure defining an enclosure for retaining a user's foot to the training fin 10. In the preferred embodiment illustrated in FIG. 2, the foot section 12 has a first opening 14 for accommodating the user's foot and ankle. The foot section 12 also has a second opening 16 for allowing the user's toes to extend outside the foot section 12.

The training fin 10 further includes tail section 18. The tail section is approximately between 0.25 and 1.0 times the surface of the foot section 12. This is far smaller than the tail section of the prior art fin 20 which approximately 3 to 5 times the surface area of the foot section. In a preferred embodiment, the tail section surface area is between 0.25 and 0.8 times the surface area of the foot section. The tail section 18 has a base 22 and is attached to the foot section 12 at the base 22. The tail section 18 diverges and terminates at a finishing edge 24.

Figure 4:
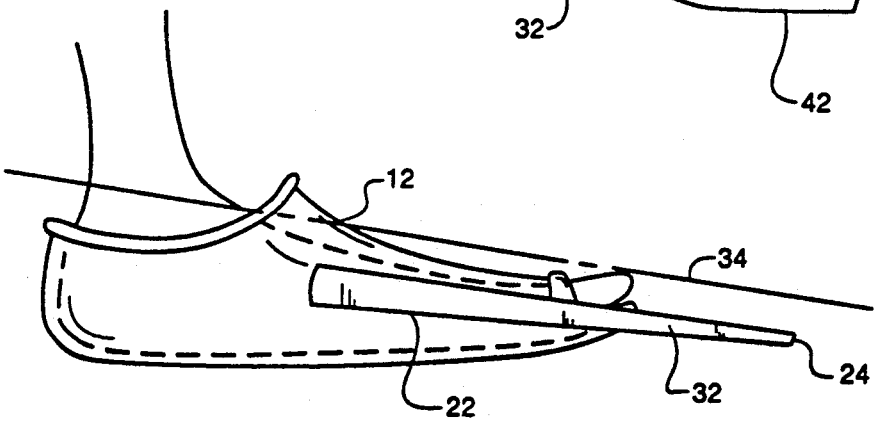
FIG. 4 is a side plan view of the embodiment shown in FIG. 1.

The tail section 18 defines a tapered plane. The tail section 18 is gradually and evenly tapered in thickness from the base 22 to the finishing edge 24. In the preferred embodiment, the base is between $\frac{5}{8}''$ and $\frac{3}{4}''$ thick and the finishing edge is approximately $\frac{1}{8}''$ to 3/16" thick. The taper is best shown in FIG. 4. This is markedly different from the prior art fin 20 which has a generally consistent cross-section from the juncture of its fin portion 26 and foot portion 28 to its terminating edge 30.

The taper adds to the flexibility of the tapered plane which increases the effective propulsion. As the user swims, the increasingly flexible plane diverts water posteriorly as the fin is moved up and down in the kicking motion, thereby helping propel the swimmer forward. The small flexible fin 10 can be moved up and down much more rapidly than the larger and stiffer prior art fin 20. This more rapid movement allows the user to swim with normal arm stroke to leg kick synchronization and coordination. The prior art fin 20 does not allow this normal arm stroke to leg kick synchronization and coordination.

The tail section 18 has diverging outside edges 32 which extend from the base 22 to the finishing edge 24. The edges 32 diverge from one another making the tail section 18 wider at the finishing edge 24 than at the base 22. The finishing edge 24 is much wider than the base 22, in the preferred embodiment, the finishing edge 24 is approximately 1.5 times as wide as the base 22.

The tail section 18, as defined by the tapered plane, is joined to the foot section 12 at a predetermined angle as best shown in FIG. 4. As can be seen is FIG. 4, there is a clear line of demarcation between the foot section 12 and the tail section 18 unlike the prior art fin 20.

The tail section 18 is preferably flat and smooth on both its upper and its lower surfaces. The absence of ridges and raised edges lightens the training fin 10, allows more rapid up and down movement and allows the greatest amount of flat surface area to be applied to the water.

When the user's foot is inserted into the foot section 12, the top surface of the user's foot defines a foot plane 34. The foot plane 34 is preferably parallel to the tapered plane. The ankle has a limited range of movement. Since the tapered plane is parallel with top surface of the foot, when the ankle is fully extended on the down kick, the tail section 18 directs water posteriorly, thereby thrusting the swimmer forward. To the extent that the foot plane is not parallel to the tapered plane, drag is increased on the movement of the foot. While drag may be beneficial to increased cardiovascular demand, the user can not obtain the maximum speed desired. The parallel planes allow excellent cardiovascular workout, while affording excellent propulsion.

Figure 3:
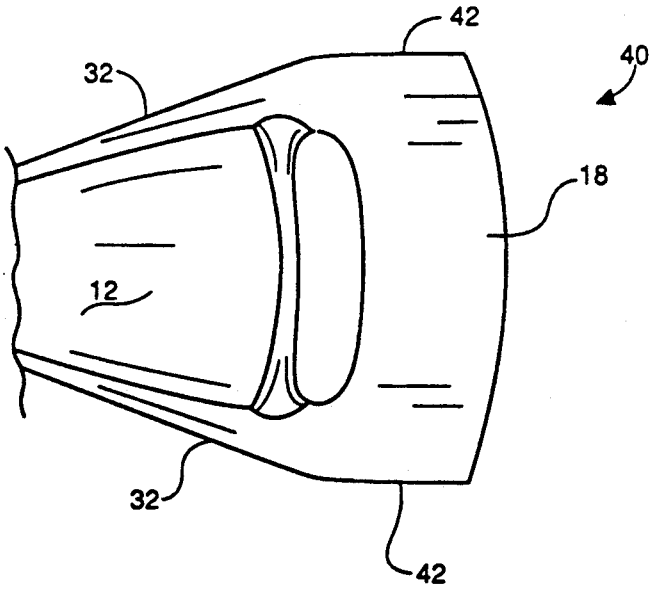
FIG. 3 is a partial sectional view of a second embodiment of the training fin in accordance with this invention.

With particular reference to FIG. 3, there is shown the second embodiment of the training fin generally denoted by the numeral 40. In all respects, except one, the first and second embodiments of the training fin, 10 and 40, respectively are alike. In that one respect, the outside edges 32 are truncated adjacent the juncture of the finishing edge 24 to define trim edges 42. The trim edges 42 are generally parallel to one another and truncate the diverging of the outside edges 32. The trim edges 42 enable the swimmers legs to go up and down close together with the minimum possibility of striking one against the other.

The foot section 12 is preferably made of the lightest material possible, while still affording the foot section 12, the strength to retain the user's foot. The preferred material is also comfortable to the user's foot. Materials such as natural rubber and synthetic rubber have been found to be particularly effective.

The tail section 18 is preferably made from light and flexible material. The tail section material 18 must be strong enough to withstand the rigors of many repeated up and down kicking motions while, flexible enough to cause water to be thrust posteriorly. Materials such as natural rubber and synthetic rubber have been found to be particularly effective.

While the foregoing detailed description has described several embodiments of the training fin in accordance with this invention, it is to be understood that the above description is illustrative only and not limiting of the disclosed invention. Particularly, the training fin in accordance with this invention fin may be made of a variety of materials and in a variety of shapes. It will be appreciated that all of these shapes and materials are within the scope and spirit of this invention. Thus the invention is to be limited only by the claims as set forth below.

What is claimed is:

1. A training fin for swimming, comprising:

a foot section having an enclosure means for retaining a user's foot to the fin, the foot section having a predetermined surface area defined by that portion of the foot section which directly covers the foot and specifically excluding any overhang; and a tail section attached to the foot section, the tail section surface area being between 0.25 and 0.8 times the surface area of the foot section.

2. A training fin for swimming, comprising:

a foot section defined by an enclosure for retaining a user's foot to the fin and having a predetermined surface area defined by that portion of the foot section which directly covers the foot; and a tail section attached to the foot section, the tail section surface area being between 0.25 and 1.0 times the surface area of the foot section.

* * * * *